US006007703A

United States Patent [19]

Morel et al.

[11] Patent Number: 6,007,703

[45] **Date of Patent: *Dec. 28, 1999**

[54] MULTI-STEP PROCESS FOR CONVERSION OF A PETROLEUM RESIDUE

[75] Inventors: Frederic Morel, Francheville; Stephane Kressmann, Serezin du Rhone; Jean-Luc Duplan, Irigny; Alain Billon, Le Vesinet; Thierry Chapus, Paris; Gerard Heinrich, Saint Germain en Laye, all of France

[73] Assignee: Institut Francais du Petrole, Rueil-Malmaison Cedex, France

[ * ] Notice: This patent is subject to a terminal disclaimer.

[21] Appl. No.: 08/942,901

[22] Filed: Oct. 1, 1997

[30] Foreign Application Priority Data

Oct. 2, 1996 [FR] France ..... 96 12101

[51] Int. Cl.[6] ..... C10G 45/00

[52] U.S. Cl. ..... 208/210; 208/58

[58] Field of Search ..... 208/210, 58

[56] References Cited

U.S. PATENT DOCUMENTS

| | | | |
|---|---|---|---|
| 2,860,436 | 9/1958 | Beuther | 196/50 |
| 3,100,663 | 8/1963 | Miller | 208/94 |
| 3,748,261 | 7/1973 | Watkins | 208/210 |
| 4,165,274 | 8/1979 | Kwant | 208/93 |
| 4,200,519 | 4/1980 | Kwant | 208/94 |
| 4,201,659 | 5/1980 | Kwant | 208/94 |
| 4,591,426 | 5/1986 | Krasuk et al. | 208/96 |
| 4,592,830 | 6/1986 | Howell | 208/94 |
| 5,034,119 | 7/1991 | Blackburn | 208/94 |

FOREIGN PATENT DOCUMENTS

| | | |
|---|---|---|
| 0 435 242 | 7/1991 | European Pat. Off. . |
| 0 665 282 | 8/1995 | European Pat. Off. . |
| 2 315 535 | 1/1977 | France . |
| 2 322 916 | 4/1977 | France . |
| 2 371 504 | 6/1978 | France . |

*Primary Examiner*—Helane Myers
*Attorney, Agent, or Firm*—Millen, White, Zelano & Branigan, P.C.

[57] ABSTRACT

A process for converting a heavy hydrocarbon fraction comprises treating the hydrocarbon feed in a hydrodemetallization section, the section comprising at least one fixed bed hydrodemetallization catalyst. At least a portion of the hydrotreated liquid effluent from step a) is sent to an atmospheric distillation zone from which a distillate and an atmospheric residue are recovered; at least a portion of the atmospheric residue is sent to a vacuum distillation zone from which a vacuum distillate and a vacuum residue are recovered; at least a portion of the vacuum residue is sent to a deasphalting section from which a deasphalted hydrocarbon cut and residual asphalt are recovered; and at least a portion of the deasphalted hydrocarbon cut is sent to a hydrotreatment section from which a gas fraction, a fuel fraction and a heavier liquid fraction of the hydrotreated feed are recovered, said section comprising at least one three-phase reactor containing at least one ebullated bed hydrotreatment catalyst operating in liquid and gas riser mode, the reactor comprising at least one means for removing catalyst from the reactor and at least one means for adding fresh catalyst to the reactor.

19 Claims, No Drawings

MULTI-STEP PROCESS FOR CONVERSION OF A PETROLEUM RESIDUE

FIELD OF THE INVENTION

The present invention concerns refining and converting heavy hydrocarbon fractions containing, among others, asphaltenes and sulphur-containing and metal-containing impurities. More particularly, it concerns a process for converting at least part of a feed with a Conradson carbon of more than 10, usually more than 15 and normally more than 20, for example a vacuum residue of a crude, to a product with a Conradson carbon which is sufficiently low and a metal and sulphur content which is sufficiently low for it to be used as a feed for the production of gas oil and gasoline by catalytic cracking in a conventional fluid bed cracking unit and/or in a fluid bed catalytic cracking unit comprising a double regeneration system, and optionally a catalyst cooling system in the regeneration step. The present invention also concerns a process for the production of gasoline and/or gas oil comprising at least one fluidised bed catalytic cracking step.

BACKGROUND OF THE INVENTION

As refiners increase the proportion of heavier crude oil of lower quality in the feed to be treated, it becomes ever more necessary to have particular processes available which are specially adapted to treatment of these residual heavy fractions from oil, shale oil, or similar materials containing asphaltenes and with a high Conradson carbon.

Thus European patent EP-B-0 435 242 describes a process for the treatment of a feed of that type, comprising a hydrotreatment step using a single catalyst under conditions which reduce the amount of sulphur and metallic impurities, bringing all the effluent with a reduced sulphur content from the hydrotreatment step into contact with a solvent under asphaltene extraction conditions to recover an extract which is relatively depleted in asphaltene and metallic impurities and sending that extract to a catalytic cracking unit to produce low molecular weight hydrocarbon products. In a preferred implementation in that patent, the product from the first step undergoes visbreaking and the product from the visbreaking step is sent to the asphaltene solvent extraction step. In Example 1 of that patent, the treated feed is an atmospheric residue. According to the teaching of that patent, it appears to be difficult to produce a feed with the characteristics which are necessary to enable treatment in a conventional catalytic cracking reactor with a view to producing a fuel from vacuum residues with a very high metal content (more than 50 ppm, usually more than 100 ppm and normally more than 200 ppm) and with a high Conradson carbon. The current limit on metal content in industrial feeds is about 20 to 25 ppm of metal, and the limit for the Conradson carbon is about 3% for a conventional catalytic cracking unit and about 8% for a unit which is specially adapted for cracking heavy feeds. The use of feeds with a metallic impurity content which is above the upper limit mentioned above causes the catalyst to be considerably deactivated, requiring substantial addition of fresh catalyst, and is thus prohibitive for the process and can even render it unworkable. Further, such a process implies the use of substantial quantities of solvent for deasphalting since all the hydrotreated and preferably visbroken product is deasphalted. The use of a single hydrotreatment catalyst limits the performances as regards elimination of metallic impurities to values of less than 75% (Table I, Example II) and/or those of desulphurization to values of no more than 85%

(Table I Example II). That technique cannot produce a feed which can be treated using conventional FCC unless the hydrotreated oil, which may have been visbroken, is deasphalted with a C3 type solvent, thus severely limiting the yield.

SUMMARY OF THE INVENTION

The present invention aims to overcome the disadvantages described above and produce, from feeds containing large amounts of metals and with high Conradson carbons and sulphur contents, a product which has been more than 80% demetallized, normally at least 90% demetallized, more than 80% and normally more than 85% desulphurized and with a Conradson carbon which is no more than 8, allowing the product to be sent to a residue catalytic cracking reactor such as a double regeneration reactor. Preferably, the Conradson carbon is no more than 3, allowing the product to be sent to a conventional catalytic cracking reactor.

In addition to the quantities of metals (essentially vanadium and/or nickel) mentioned above, feeds which can be treated in accordance with the present invention normally contain at least 0.5% by weight of sulphur, frequently more than 1% by weight of sulphur, more often more than 2% by weight of sulphur and most often up to 4% or even up to 10% by weight of sulphur and at least 1% by weight of $C_7$ asphaltenes. The $C_7$ asphaltene content in feeds treated in accordance with the present invention is normally more than 2%, more often more than 5% by weight and can equal or exceed 24% by weight. These feeds are, for example, those for which the characteristics are given in the article by BILLON et al., published in 1994, volume 49 no. 5 of the review by the INSTITUT FRANCAIS DU PETROLE, pages 495–507.

In its widest form, the present invention is defined as a process for converting a heavy hydrocarbon fraction with a Conradson carbon of at least 10, a metal content of at least 50 ppm, usually at least 100 ppm, and normally at least 200 ppm by weight, a $C_7$ asphaltene content of at least 1%, usually at least 2% and normally at least 5% by weight, and a sulphur content of at least 0.5%, usually at least 1% and normally at least 2% by weight, characterized in that it comprises the following steps:

a) treating the hydrocarbon feed in a treatment section in the presence of hydrogen, the section comprising at least one reactor containing at least one fixed bed hydrodemetallization catalyst, preferably at least one hydrodemetallization catalyst and at least one hydrodesulphurization catalyst in fixed beds under conditions such that a liquid effluent with a reduced metal content and a reduced Conradson carbon, and preferably also a reduced sulphur content, is produced;

b) sending at least a portion, normally all, of the hydrotreated liquid effluent from step a) to an atmospheric distillation zone, from which an atmospheric distillate and an atmospheric residue are recovered;

c) sending at least a portion, normally all, of the atmospheric residue from step b) to a vacuum distillation zone from which a vacuum distillate and a vacuum residue are recovered;

d) sending at least a portion, preferably all, of the vacuum residue from step c) to a deasphalting section in which it is treated in an extraction section using a solvent under conditions such that a deasphalted hydrocarbon cut and residual asphalt are recovered;

e) sending at least a portion, preferably all, of the deasphalted hydrocarbon cut from step d) to a hydrotreatment section, preferably mixed with at least a portion of the vacuum distillate from step c) and possibly with all of that vacuum distillate, in which section it is hydrotreated in the presence of hydrogen under conditions such that an effluent with a reduced Conradson carbon, metal content and sulphur content is produced, and after separation, a gas fraction, an atmospheric distillate which can be separated out into a gasoline fraction and a gas oil fraction and which are normally sent at least in part to the corresponding gasoline pools, and a heavier liquid fraction of the hydrotreated feed are recovered, said section comprising at least one three-phase reactor containing at least one ebullated bed hydrotreatment catalyst, operating in liquid and gas riser mode, said reactor comprising at least one means for removing catalyst from the reactor and at least one means for adding fresh catalyst to the reactor.

In a variation, the heavier liquid fraction of the hydrotreated feed from step e) is sent to a catalytic cracking section (step f)), optionally mixed with at least a portion of the vacuum distillate produced in step c) in which it is treated under conditions such that a gaseous fraction, a gasoline fraction, a gas oil fraction and a slurry fraction are produced.

The gas fraction contains mainly saturated and unsaturated hydrocarbons containing 1 to 4 carbon atoms per molecule (methane, ethane, propane, butanes, ethylene, propylene, butylenes). The gasoline fraction is, for example, at least in part and preferably all sent to the gasoline pool. The gas oil fraction is sent at least in part to step a), for example. The slurry fraction is usually sent at least in part, or even all, to the heavy gasoline pool in the refinery, generally after separating out the fine particles suspended therein. In a further implementation of the invention, the slurry fraction is at least partially or even all returned to the inlet to the catalytic cracking section in step f).

Conditions in step a) for treating the feed in the presence of hydrogen are normally as follows. In the hydrodemetallization zone, at least one conventional fixed bed hydrodemetallization catalyst is used, preferably at least one of the catalysts described by us, in particular in EP-B-0 113 297 and EP-B-0 113 284. Normal operating conditions are an absolute pressure of 5 to 35 MPa, usually 10 to 20 MPa, a temperature of about 300° C. to 500° C., usually about 350° C. to about 450° C. The GSV and the hydrogen partial pressure are important factors which are selected as a function of the characteristics of the feed to be treated and the conversion desired. Normally, the HSV is about 0.1 $h^{-1}$ to about 5 $h^{-1}$, preferably about 0.15 $h^{-1}$ to about 2 $h^{-1}$. The quantity of hydrogen mixed with the feed is normally about 100 to about 5000 normal cubic metres ($Nm^3$) per cubic metre ($m^3$) of liquid feed, usually about 500 to about 3000 $Nm^3/m^3$. It is useful to operate in the presence of hydrogen sulphide and the partial pressure of hydrogen sulphide is normally about 0.002 times to about 0.1 times, preferably about 0.005 times to about 0.05 times, the total pressure. In the hydrodesulphurization zone, the ideal catalyst must have a strong hydrogenating power to effect deep refining of the products from the demetallization step, and to obtain a substantial drop in the sulphur level, Conradson carbon and asphaltene content. One of the catalysts described by us in EP-B-0 113 297 and EP-B-0 113 284 can, for example, be used. When the hydrodesulphurization zone is distinct from the hydrodemetallization zone, it is possible to operate at a relatively low temperature, i.e., substantially lower than the temperature in the hydrodemetallization zone, which leads to deep hydrogenation and a limit to coking. The present invention includes in its scope the use of the same catalyst in both zones and putting the two zones together so that they form just one zone in which hydrodemetallization and hydrodesulphurization are carried out simultaneously or successively with a single catalyst or with a plurality of different catalysts.

In step a), at least one catalyst can be used to ensure both demetallization and desulphurization, under conditions such that a liquid feed is produced which has a reduced metal content, a reduced Conradson carbon and a reduced sulphur content. It is also possible to use at least two catalysts, one ensuring mainly demetallization and the other, mainly desulphurization under conditions which produce a liquid feed with a reduced metal content, Conradson carbon and sulphur content.

In the atmospheric distillation zone of step b), the conditions are generally selected such that the cut point is about 300° C. to about 400° C., preferably about 340° C. to about 380° C. The distillate produced is normally sent to the corresponding gasoline pools, generally after separation into a gasoline fraction and a gas oil fraction. In a particular implementation, at least a portion, possibly all, of the gas oil fraction of the atmospheric distillate is sent to hydrotreatment step e). The atmospheric residue can be sent at least in part to the refinery's gasoline pool.

In the vacuum distillation zone of step c) where the atmospheric residue from step b) is treated, the conditions are generally selected such that the cut point is about 450° C. to 600° C., normally about 500° C. to 550° C. The distillate produced is normally sent at least in part to hydrotreatment step e) and the vacuum residue is sent at least in part to deasphalting step d). In a particular implementation of the invention, at least a portion of the vacuum residue is sent to the refinery's heavy gasoline pool. It is also possible to recycle at least a portion of the vacuum residue to step a). The vacuum distillate can also, usually after separation into a gasoline fraction and a gas oil fraction, be sent at least in part to the corresponding gasoline pools. This distillate or one of these fractions can also be sent at least in part to catalytic cracking step f).

Solvent deasphalting step d) is carried out under conventional conditions which are well known to the skilled person. Reference should be made in this respect to the article by BILLON et al., published in 1994, volume 49, number 5 of the review by the INSTITUT FRANCAIS DU PETROLE, pages 495–507, or to the description given in our patent FR-B-2 480 773 or FR-B-2 681 871, or in our U.S. Pat. No. 4,715,946, the descriptions of which are hereby considered to be incorporated by reference. Deasphalting is normally carried out at a temperature of 60° C. to 25° C. with at least one hydrocarbon solvent containing 3 to 7 carbon atoms, which may contain at least one additive. Suitable solvents and additives have been widely described in the documents cited above and in U.S. Pat. No. 1,948,296, U.S. Pat. No. 2,081,473, U.S. Pat. No. 2,587,643, U.S. Pat. No. 2,882,219, U.S. Pat. No. 3,278,415 and U.S. Pat. No. 3,331,394, for example. The solvent can also be recovered using the opticritical process, i.e., using a solvent under supercritical conditions. That process can substantially improve the overall economy of the process. Deasphalting can be carried out in a mixer settler or in an extraction column. In the present invention, at least one extraction column is preferably used.

Step e) for hydrotreatment of the deasphalted hydrocarbon cut is carried out under conventional conditions for ebullated bed hydrotreatment of a liquid hydrocarbon fraction. An absolute pressure of 2 MPa to 25 MPa is normally used, normally 5 MPa to 15 MPa, at a temperature of about 300° C. to about 550° C., usually about 350° C. to about 500° C. The hourly space velocity (HSV) and partial pressure of hydrogen are important factors which are selected as a function of the characteristics of the feed to be treated and the desired conversion. Normally, the HSV is in a range from about 0.1 $h^{-1}$ to about 10 $h^{-1}$, preferably about 0.2 $h^{-1}$ to about 5 $h^{-1}$. The quantity of hydrogen mixed with the feed is normally about 50 to about 5000 normal cubic metres ($Nm^3$) per cubic metre ($m^3$) of liquid feed, usually about 100 to about 3000 $Nm^3/m^3$. A conventional granular hydrotreatment catalyst can be used. The catalyst can be a catalyst comprising group VIII metals, for example nickel and/or cobalt, normally combined with at least one group VIB metal, for example molybdenum. As an example, a catalyst comprising 0.5% to 10% of nickel, preferably 1% to 5% by weight of nickel (expressed as nickel oxide NiO) and 1% to 30% by weight of molybdenum, preferably 5% to 20% by weight of molybdenum (expressed as molybdenum oxide $MoO_3$) on a support is used, for example an alumina support. The catalyst is normally in the form of extrudates or spherules. Used catalyst is replaced in part by fresh catalyst by extraction from the bottom of the reactor and introduction of fresh or new catalyst to the top of the reactor at regular intervals, for example in batches or quasi continuously. Fresh catalyst can, for example, be introduced daily. The rate of replacement of used catalyst by fresh catalyst can, for example, be about 0.05 kilograms to about 10 kilograms per cubic metre of feed. Extraction and replacement are effected using apparatus which allows continuous operation of this step of the hydrotreatment. The unit normally comprises a recirculating pump which can keep the catalyst in an ebullated bed by continuous recycling of at least a portion of the liquid extracted overhead from the reactor and re-injected at the bottom of the reactor.

Hydrotreatment step e) is normally carried out under T-STAR process conditions as described, for example, in the article "Heavy Oil Hydroprocessing" published by Aiche, March 19–23, Houston, Tex., paper number 42d.

The products obtained during step e) are normally sent to a separation zone from which a gas fraction and a liquid fraction are recovered. The liquid fraction can be sent to a second separation zone in which it can be separated into light fractions, for example gasoline and gas oil, which can be sent at least in part to gasoline pools, and into a heavier fraction. The heavier fraction normally has an initial boiling point of at least 340° C., normally at least 370° C. This heavier fraction can be sent at least in part to a refinery's heavy gasoline pool with a very low sulphur content (normally less than 0.5% by weight).

In one particular embodiment of the invention, at least one means which can improve the viscosity of the overall feed which is treated in step a) for treatment in the presence of hydrogen is advantageously provided. A low viscosity means that the pressure drops in the reactor(s) used in this treatment section can be reduced. This is particularly important when the section contains several reactors, since in this case the overall pressure drop of the whole of the section becomes very high and adversely affect the process. The drop in the partial pressure of hydrogen in the reactors is very bad for efficient operation of this step for treatment in the presence of hydrogen, and further it causes the compressors which recycle hydrogen to the reactors to function inefficiently. Improving the fluidity of the feed also allows the temperature of the furnaces to be reduced and thus lower skin temperatures to be reached, meaning that either cheaper steel can be used, or the service life of the furnaces is longer for a furnace produced from a given steel In this particular embodiment, at least a portion of the distillate obtained by atmospheric distillation in step b), and/or at least a portion of the distillate obtained by vacuum distillation in step c), and/or at least a portion of the fuel fraction (atmospheric distillate) obtained in step e), can be sent to step a).

Finally, in the variation mentioned above, in a catalytic cracking step f) at least a portion of the heavier fraction of the hydrotreated feed produced in step e) can be sent to a conventional catalytic cracking section in which is it catalytically cracked in conventional fashion under conditions which are known to the skilled person, to produce a fuel fraction (comprising a gasoline fraction and a gas oil fraction) which is normally sent at least in part to the gasoline pools, and into a slurry fraction which is, for example, at least in part or even all sent to a heavy gasoline pool or is at least in part, or all, recycled to catalytic cracking step f). In a particular implementation of the invention, a portion of the gas oil fraction produced during step f) is recycled either to step a) or to step e) or to step f) mixed with the feed introduced into catalytic cracking step f. In the present description, the term "a portion of the gas oil fraction" means a fraction which is less than 100%. The scope of the present invention includes recycling a portion of the gas oil fraction to step a), a further portion to step f) and a third portion to step e), the sum of these three portions not necessarily representing the whole of the gas oil fraction. It is also possible, within the scope of the invention, to recycle all of the gas oil obtained by catalytic cracking either to step a), or to step f), or to step e), or a fraction to each of these steps, the sum of these fractions representing 100% of the gas oil fraction produced in step f). At least a portion of the gasoline fraction obtained in catalytic cracking step f) can also be recycled to step f).

As an example, a summary description of catalytic cracking (first industrial use as far back as 1936 [HOUDRY process] or 1942 for the use of a fluidised bed catalyst) is to be found in ULLMANS ENCYCLOPEDIA OF INDUSTRIAL CHEMISTRY VOLUME A18, 1991, pages 61 to 64. Normally, a conventional catalyst is used which comprises a matrix, possibly an additive and at least one zeolite. The quantity of zeolite can vary but is normally about 3% to 60% by weight, usually about 6% to 50% by weight and most often about 10% to 45% by weight. The zeolite is normally dispersed in the matrix. The quantity of additive is usually about 0 to 30% by weight, more often 0 to 20% by weight. The quantity of matrix represents the complement to 100% by weight. The additive is generally selected from the group formed by oxides of metals from group IIA of the periodic classification of the elements, for example magnesium oxide or calcium oxide, rare-earth oxides and titanates of metals from group IIA. The matrix is usually a silica, an alumina, a silica-alumina, a silica-magnesia, a clay or a mixture of two or more of these substances. Y zeolite is most frequently used. Cracking is carried out in a reactor which is substantially vertical, either in riser or in dropper mode. The choice of catalyst and operating conditions are a function of the desired products, dependent on the feed which is treated as described, for example, in the article by M MARCILLY, pages 990–991 published in the review by the INSTITUT FRANCAIS DU PETROLE, Nov–Dec 1975, pages 969–1006. A temperature of about 450° C. to about 600° C. is normally used and the residence times in the reactor are less than 1 minute, generally about 0.1 to about 50 seconds.

Catalytic cracking step f) can also be a fluidised bed catalytic cracking step, for example the process developed by ourselves known as R2R. This step can be carried out conventionally in a fashion which is known to the skilled person under suitable residue cracking conditions to produce hydrocarbon products with a lower molecular weight. Descriptions of the operation and suitable catalysts for fluidised bed catalytic cracking in step f) are described, for example, in U.S. Pat. No. 4,695,370, EP-B-0 184 517, U.S. Pat. No. 4,959,334, EP-B-0 323 297, U.S. Pat. No. 4,965,232, U.S. Pat. No. 5,120,691, U.S. Pat. No. 5,344,554, U.S. Pat. No. 5,449,496, EP-A-0 485 259, U.S. Pat. No. 5,286,690, U.S. Pat. No. 5,324,696 and EP-A-0 699 224, the descriptions of which are considered to be hereby incorporated by reference. In this particular implementation, it is possible in step f) to introduce catalytic cracking of at least a portion of the atmospheric residue obtained from step b).

The fluidised bed catalytic cracking reactor may operate in riser or dropper mode. Although it does not constitute a preferred implementation of the present invention, it is also possible to carry out catalytic cracking in a moving bed reactor. Particularly preferred catalytic cracking catalysts are those containing at least one zeolite which is normally mixed with a suitable matrix such as alumina, silica or silica-alumina.

In a particular implementation when the treated feed is a vacuum residue from vacuum distillation of an atmospheric distillation residue of a crude oil, it is advantageous to recover the vacuum distillate and send at least part or all of it to step e) in which it is hydrotreated mixed with the deasphalted hydrocarbon cut produced in step d). When only part of the vacuum distillate is sent to step e), the other portion is preferably sent to step a) for treatment in the presence of hydrogen.

In a further variation, a portion of the deasphalted hydrocarbon cut produced in step d) is recycled to hydrotreatment step a).

In a preferred form of the invention, the residual asphalt produced in step d) is sent to an oxyvapogasification section in which it is transformed into a gas containing hydrogen and carbon monoxide. This gaseous mixture can be used to synthesise methanol or hydrocarbons using the Fischer-Tropsch reaction. Within the context of the present invention, this mixture is preferably sent to a shift conversion section in which it is converted to hydrogen and carbon dioxide in the presence of steam. The hydrogen obtained can be used in steps a) and e) of the present invention. The residual asphalt can also be used as a solid fuel, or after fluxing, as a liquid fuel.

EXAMPLE

A Safinaya heavy vacuum residue (VR) was treated; its characteristics are shown in Table 1, column 1. All yields were calculated from a base of 100 (by weight) of VR.

The Safinaya vacuum residue was treated in a catalytic hydrotreatment section. The unit was a pilot unit simulating the operation of an industrial HYVAHL® unit. The pilot unit comprised two reactors in series operating in dropper mode. The reactors were each charged with fixed beds of 7 liters of hydrodemetallization catalyst HMC841 produced by Procatalyse.

The operating conditions were as follows:

HSV=0.5 $h^{-1}$

P=150 bar

Hydrogen recycle=1000 l $H_2$/l of feed

T=380° C.

The characteristics of the total $C_5^+$liquid effluent from the reactor are shown in Table 1, column 2. The product was then fractionated, in succession, in an atmospheric distillation column from which an atmospheric residue (AR) was collected as a bottoms product, then the AR was fractionated in a vacuum distillation column producing a vacuum distillate (VD) and a vacuum residue (VR). The yields and characteristics of these products are shown in Table 1 in columns 3, 5 and 4 respectively. In the atmospheric distillation step, a distillate was recovered which was sent to gasoline pools after separation of a gasoline fraction and a gas oil fraction.

The vacuum residue was then deasphalted in a pilot unit which simulated the SOLVAHL® deasphalting process. The pilot unit operated with a vacuum residue flow rate of 5 l/h, the solvent was a pentane cut used in a ratio of 5/1 by volume with respect to the feed. A deasphalted oil cut (DAO) was produced—the yield and characteristics are shown in Table 1 column 6; a residual asphalt was also produced.

The DAO cut was remixed with the VD cut from the preceding step. The VD+DAO mixture was then catalytically hydrotreated in an ebullated bed pilot unit. The reactor was a tube reactor and had a volume of 3 liters. The catalyst was that described in Example 2 of U.S. Pat. No. 4,652,545, reference HDS-1443 B. The operating conditions were as follows:

HSV=2 with respect to catalyst

P=80 bar

T=420° C.

Hydrogen recycle=400 l $H_2O$/l of feed

Catalyst replacement rate: 0.3 kg/$m^3$

Table 1 shows the characteristics of the VD+DAO mixture (column 7) used and the characteristics of the product obtained at the end of the hydrotreatment step (column 8).

The feed, preheated to 149° C., was brought into contact at the bottom of a vertical pilot reactor with a hot regenerated catalyst from a pilot regenerator. The inlet temperature of the catalyst in the reactor was 740° C. The ratio of the catalyst flow rate to the feed flow rate was 6.64. The heat added by the catalyst at 740° C. allowed the feed to vaporise and allowed the cracking reaction, which is endothermic, to take place. The average residence time of the catalyst in the reaction zone was about 3 seconds. The operating pressure was 1.8 bars absolute. The temperature of the catalyst, measured at the riser flow fluidised bed reactor outlet, was 520° C. The cracked hydrocarbons and the catalyst were separated using cyclones located in a stripper zone where the catalyst was stripped. The catalyst, which was coked during the reaction and stripped in the stripping zone, was then sent to the regenerator. The coke content in the solid (delta coke) at the regenerator inlet was 1%. The coke was burned off by air injected into the regenerator. The highly exothermic combustion raised the temperature of the solid from 520° C. to 740° C. The hot regenerated catalyst left the regenerator and was returned to the bottom of the reactor.

The hydrocarbons separated from the catalyst left the stripping zone; they were cooled in exchangers and sent to a stabilising column which separated the gas and the liquids. The ($C_5^+$) liquid was also sampled then fractionated in a further column to recover a gasoline fraction, a gas oil fraction and a heavy fuel or slurry fraction (360° C.+).

Tables 2 and 3 show the yields of gasoline and gas oil and principal characteristics of these products produced over the whole of the process.

TABLE 1

Yields and qualities of feed and products

| Cut | 1 VR Safaniya | 2 C5+ ex HYVAHL | 3 AR ex HYVAHL | 4 VR ex HYVAHL |
|---|---|---|---|---|
| Yield/VR % wt | 100 | 97 | 87 | 68 |
| Density 15/4 | 1.030 | 0.986 | 1.004 | 1.022 |
| Sulphur, % wt | 5.3 | 2.6 | 2.9 | 3.2 |
| Conradson carb, % wt | 23.8 | 16 | 18 | 22.5 |
| C7 asphaltenes, % wt | 13.9 | 6 | 7 | 8.9 |
| Ni + V, ppm | 225 | 63 | 70 | 90 |

| Cut | 5 VD ex HYVAHL | 6 DAO C5 ex VR | 7 VD + DAO | 8 VD + DAO ex T-STAR |
|---|---|---|---|---|
| Yield/VR % wt | 19 | 48 | 67 | 29 |
| Density 15/4 | 0.945 | 0.982 | 0.971 | 0.921 |
| Sulphur, % weight | 1.6 | 2.4 | 2.2 | 0.3 |
| Conradson carb, % wt | 1.3 | 9 | 6.8 | 2.0 |
| C7 asphaltenes, % wt | <0.02 | <0.05 | <0.05 | <0.1 |
| Ni + V, ppm | <1 | 3 | <3 | <1 |

TABLE 2

Balance and characteristics of gasoline produced

| | Gasoline HYVAHL | Gasoline ex T-STAR | Gasoline ex FCC | Gasoline Total |
|---|---|---|---|---|
| Yield/VR % wt | 1 | 7 | 15 | 23 |
| Yield 15/4 | 0.760 | 0.730 | 0.746 | 0.742 |
| Sulphur, % wt | 0.02 | 0.004 | 0.008 | 0.007 |
| Octane (RON + MON)/2 | 50 | 55 | 86 | 75 |

TABLE 3

Balance and characteristics of gas oil produced

| | Gas oil HYVAHL | Gas oil ex T-STAR | Gas oil ex FCC | Gas oil Total |
|---|---|---|---|---|
| Yield/VR % wt | 9 | 27 | 4 | 40 |
| Yield 15/4 | 0.865 | 0.860 | 0.948 | 0.870 |
| Sulphur, % wt | 0.5 | 0.02 | 0.49 | 0.18 |
| Cetane | 41 | 43 | 23 | 40 |

The preceding examples can be repeated with similar success by substituting the generically or specifically described reactants and/or operating conditions of this invention for those used in the preceding examples.

The entire disclosure of all applications, patents and publications, cited above and below, and of corresponding French application 96/12101, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

We claim:

1. A process for converting a heavy hydrocarbon fraction with a Conradson carbon of at least 10, a metal content of at least 50 ppm, a $C_7$ asphaltene content of at least 1%, and a sulphur content of at least 0.5%, characterized in that it comprises the following steps:

a) treating the hydrocarbon feed in a treatment section in the presence of hydrogen, the section comprising at least one reactor containing at least one fixed bed hydrodemetallization catalyst under conditions which will produce a liquid effluent with a reduced metal content and Conradson carbon;

b) sending at least a portion of the hydrotreated liquid effluent from step a) to an atmospheric distillation zone, from which an atmospheric distillate and an atmospheric residue are recovered;

c) sending at least a portion of the atmospheric residue from step b) to a vacuum distillation zone from which a vacuum distillate and a vacuum residue are recovered;

d) sending at least a portion of the vacuum residue from step c) to a deasphalting section in which it is treated in an extraction section using a solvent under conditions such that a deasphalted hydrocarbon cut and residual asphalt are recovered;

e) sending at least a portion of the deasphalted hydrocarbon cut from step d) to a hydrotreatment section in which it is hydrotreated in the presence of hydrogen under conditions such that an effluent with a reduced Conradson carbon, metal content and sulphur content is produced, and after separation, a gas fraction, a fuel fraction and a heavier liquid fraction of the hydrotreated feed are recovered, said section comprising at least one three-phase reactor containing at least one ebullated bed hydrotreatment catalyst, operating in liquid and gas riser mode, said reactor comprising at least one means for removing catalyst from the reactor and at least one means for adding fresh catalyst to the reactor;

at least a portion of the heavier liquid fraction produced in step e) is sent to a catalytic cracking section in which it is treated under conditions such that a gaseous fraction, a gasoline fraction, a gas oil fraction and a slurry fraction are produced.

2. A process according to claim 1, in which during step a), treatment in the presence of hydrogen is carried out at an absolute pressure of 5 to 35 MPa, at a temperature of about 300° C. to 500° C. with an hourly space velocity of about 0.1 $h^{-1}$ to 5 $h^{-1}$.

3. A process according to claim 1, in which at least a portion of the gas oil fraction recovered in catalytic cracking step f) is returned to step a).

4. A process according to claim 1, in which deasphalting is carried out at a temperature of 60° C. to 250° C. with at least one hydrocarbon solvent containing 3 to 7 carbon atoms.

5. A process according to claim 1, in which the distillate obtained by vacuum distillation in step c) is sent at least in part to hydrotreatment step e).

6. A process according to claim 1, in which hydrotreatment step e) is carried out at an absolute pressure of about 2 MPa to 25 MPa, at a temperature of about 300° C. to 550° C. with an hourly space velocity of about 0.1 $h^{-1}$to 10 $h^{-1}$ and the quantity of hydrogen mixed with the feed is about 50 to 5000 $Nm^3/m^3$.

7. A process according to claim 1, in which catalytic cracking step f) is carried out under conditions in which a gasoline fraction is produced which is sent at least in part to the gasoline pool, also a gas oil fraction is produced which is sent at least in part to the gas oil pool, and a slurry fraction is produced which is sent at least in part to the heavy gasoline pool.

8. A process according to claim 1, in which at least a portion of the vacuum residue produced in step c) is recycled to step a).

9. A process according to claim 1, in which at least a portion of the heavier liquid fraction of the hydrotreated feed produced in step e) is sent to a very low sulphur content heavy fuel pool.

10. A process according to claim 1, in which at least a portion of the gas oil fraction and/or the gasoline fraction produced in catalytic cracking step f) is recycled to the inlet to said step f).

11. A process according to claim 1, in which at least a portion of the slurry fraction produced in catalytic cracking step f) is recycled to the inlet to said step f).

12. A process according to claim 1, in which a portion of the deasphalted hydrocarbon cut produced in step d) is recycled to hydrotreatment step a).

13. A process according to claim 1, in which the treated feed is a vacuum residue from vacuum distillation of an atmospheric distillation residue of a crude oil and at least part of the vacuum distillate is sent to hydrotreatment step e).

14. A process according to claim 1, in which the distillates produced in step b) and/or step e) are separated into a gasoline fraction and a gas oil fraction which are sent at least in part to their respective gasoline pools.

15. A process according to claim 1, in which the distillate produced in step c) or one of the fractions of this distillate is sent at least in part to catalytic cracking step f).

16. A process according to claim 1, in which the atmospheric distillate produced in step b) is separated into a gasoline fraction and a gas oil fraction of which at least a portion is sent to hydrotreatment step e).

17. A process for converting a heavy hydrocarbon fraction with a Conradson carbon of at least 10 a metal content of at least 50 ppm, a $C_7$ asphaltene content of at least 1%, and a sulphur content of at least 0.5%, characterized in that it comprises the following steps;

a) treating the hydrocarbon feed in a treatment section in the presence of hydrogen, the section comprising at least one reactor containing at least one fixed bed hydrodemetallization catalyst under conditions which will produce a liquid effluent with a reduced metal content and Conradson carbon;

b) sending at least a portion of the hydrotreated liquid effluent from step a) to an atmospheric distillization zone, from which atmospheric distillate and an atmospheric residue are recovered;

c) sending at least a portion of the atmospheric residue from step b) to a vacuum distillation zone from which a vacuum distillate and a vacuum residue are recovered;

d) sending at least a portion of the vacuum residue from step c) to a deasphalting section in which it is treated in an extraction section using a solvent under conditions such that a deasphalted hydrocarbon cut and residual asphalt are recovered;

e) sending at least a portion of the deasphalted hydrocarbon cut from step d) to a hydrotreatment section in which it is hydrotreated in the presence of hydrogen under conditions such that an effluent with a reduced Conradson carbon, metal content and sulphur content is produced, and after separation, a gas fraction, a fuel fraction and a heavier liquid fraction of the hydrotreated feed are recovered said section comprising at least one three-phase reactor containing at least one ebullated bed hydrotreatment catalyst, operating in liquid and gas riser mode, said reactor comprising at least one means for removing catalyst from the reactor and at least one means for adding fresh catalyst to the reactor wherein at least a portion of the distillate obtained by atmospheric distillation in step b) is sent to hydroconversion step a).

18. A process according to claim 1, in which at least a portion of the distillate obtained by vacuum distillation in step c) is sent to hydroconversion step a).

19. A process according to claim 1, in which at least a portion of the fuel fraction obtained in step e) is sent to hydroconversion step a).

* * * * *